United States Patent [19]

Chervenak et al.

[11] Patent Number: 4,521,295

[45] Date of Patent: Jun. 4, 1985

[54] SUSTAINED HIGH HYDROCONVERSION OF PETROLEUM RESIDUA FEEDSTOCKS

[75] Inventors: Michael C. Chervenak, Pennington; Richard M. Eccles, Princeton, both of N.J.; Govanon Nongbri, Newtown, Pa.

[73] Assignee: HRI, Inc., Gibbsboro, N.J.

[21] Appl. No.: 453,260

[22] Filed: Dec. 27, 1982

[51] Int. Cl.[3] ..... C10G 65/10

[52] U.S. Cl. ..... 208/59; 208/102; 208/48 R

[58] Field of Search ..... 208/59, 100, 102, 108, 208/48 R

[56] References Cited

U.S. PATENT DOCUMENTS

| | | | |
|---|---|---|---|
| 1,974,057 | 9/1934 | Steffen et al. | 208/59 |
| 3,215,617 | 11/1965 | Burch et al. | 208/59 |
| 3,224,959 | 12/1965 | Schlinger et al. | 208/107 |
| 3,842,122 | 10/1974 | Wolk et al. | 208/48 Q |

*Primary Examiner*—Delbert E. Gantz
*Assistant Examiner*—O. Chaudhuri
*Attorney, Agent, or Firm*—Fred A. Wilson

[57] ABSTRACT

A process for high hydroconversion of petroleum residua containing at least about 25 V % material boiling above 975° F. to produce lower boiling hydrocarbon liquid products and avoid undesirable precipitation of asphaltene compounds. In the process, the feedstock is at least about 80 percent catalytically hydroconverted to material boiling below 975° F. and containing a mixture of gas and liquid fractions, after which the gas fraction is removed while maintaining the resulting liquid fractions temperature above about 730° F. to avoid precipitation of asphaltene compounds which causes operations difficulties in the downstream equipment. Alternatively, the pressure-reduced liquid fraction can be stripped of material boiling below about 650° F. before cooling the liquid to a temperature below about 730° F. to prevent such precipitation of asphaltene compounds in the downstream equipment. The resulting liquid fraction is distilled to produce hydrocarbon liquid products, and a vacuum bottoms fraction is recycled to the catalytic reaction step to obtain increased percent conversion to lower boiling liquid products.

17 Claims, 3 Drawing Figures

GAS
NAPHTHA
DISTILLATE LIQUID
HVY. DISTILLATE
VENT
GAS
FEED
H2

SUSTAINED HIGH HYDROCONVERSION OF PETROLEUM RESIDUA FEEDSTOCKS

BACKGROUND OF THE INVENTION

This invention pertains to a process for catalytic hydroconversion of petroleum residua feedstocks to produce lower boiling hydrocarbon liquid products. It pertains particularly to such a hydroconversion process in which the separated and pressure-reduced liquid fraction is treated so as to avoid precipitation of contained asphaltene compounds in downstream processing equipment and provide sustained high conversion operations.

The catalytic hydrogenation of petroleum residua feedstock in an ebullated-bed reactor is well known. In U.S. Pat. No. Re. 25,770 to Johanson, a process is disclosed whereby the ebullated bed catalytic reactor is used to accomplish hydroconversion of material boiling above 975° F. in an expanded catalyst bed to produce lower boiling distillates, the catayst particles being maintained in random motion by upward flow of the reactants. The recycle of reactants boiling above about 680° F. to the reaction zone is disclosed in U.S. Pat. No. 3,412,010 to Alpert, et al. The recycle of such heavy fractions permits operation at high levels of conversion of the 975° F.+ material, and permits such operation at higher reactor space velocity if the recycle consists primarily of material boiling above about 875° F. Also, moderate conversion of petroleum residua feedstocks to remove asphaltenes prior to desulfurization is disclosed in U.S. Pat. No. 3,948,756 to Wolk et al. It has been known that operations on petroleum residua at high hydroconversion levels, i.e., above about 75 V %, are not sustainable when the depressurized vaporous and liquid effluents from the catalytic reactor are permitted to mix under conditions of cooling to below about 750° F., as disclosed in U.S. Pat. No. 3,338,820 to Wolk et al. However, it has been observed that for conversions above about 85 V % this arrangement does not result in sustained operations. These high conversion conditions cause precipitation of asphaltenes in a meso-hpase which fouls and can even plug the downstream equipment, and when recycled to the reactor such asphaltenes cause the catalyst bed to agglomerate and defluidize. A long-sought solution to this asphaltene precipitation problem is advantageously and unexpectedly provided by the present invention.

SUMMARY OF THE INVENTION

The present invention provides a process for the hydroconversion of petroleum residua containing at least about 25 V % of material boiling above 975° F. to produce lower boiling hydrocarbon liquid products. The process comprises reacting the feed in the liquid phase with hydrogen at elevated temperatures and pressure conditions in an ebullated bed catalyst reaction zone, separating the reaction effluent material into vaporous and liquid fractions in a separation zone, recovering said vaporous fraction under conditions which preclude mixing of vaporous and pressure-reduced liquid fractions under cooling conditions below a critical temperature of about 730° F., then distilling said liquid fractions to produce hydrocarbon liquid products and a residue material boiling above about 875° F., and recycling said residue to the reaction zone. Alternatively, the critical temperature of the pressure-reduced liquid can be lowered from 730° F. to about 650° F. by an increasing degree of stripping from the liquid of the hydrocarbon fractions normally boiling below about 650° F., and which can be removed by gas stripping. This process results in sustained operations of hydroconversion of the 975° F.+ material in the fresh feed in the range of 80 to 98 V %, without precipitation of asphaltenes in the reactor or in downstream process equipment.

More specifically, the invention comprises a process for high conversion of petroleum residua feedstock material containing at least about 25 V % material boiling above about 975° F. to produce lower boiling hydrocarbon liquid products, comprising the steps of feeding a petroleum residua feedstock together with hydrogen into a reaction zone containing an ebullated catalyst bed, maintaining said reaction zone at 750°–900° F. temperature, and 1000–5000 psig hydrogen partial pressure for liquid phase reaction to produce a hydroconverted material containing a mixture of gas and liquid fractions; separating said gas fraction from said liquid fractions while maintaining the liquid fraction temperature above about 730° F., pressure-reducing said liquid fraction to a pressure below about 200 psig and flashing vapor from the liquid fraction while maintaining the resulting liquid temperature above a critical temperature of about 730° F.; and distilling said liquid fraction at a vacuum pressure to produce hydrocarbon liquid products having a boiling temperature below about 875° F. and a vacuum bottoms material. A portion of the vacuum bottoms material is advantageously recycled to the reaction zone to provide increased conversion to lower boiling hydrocarbon liquid products. If desired, the invention can utilize two catalytic reactors connected in series, with the effluent from the second reactor being phase separated and the resulting liquid fraction pressure-reduced and treated in accordance with the invention.

It is an advantage of this invention that by maintaining the necessary temperature levels precipitation of asphaltenes is avoided in the reactor and downstream equipment and sustained high conversion operations, i.e., above about 85 V % of 975° F.+ material, are achieved.

DESCRIPTION OF INVENTION

It has now been unexpectedly found that satisfactory sustained operations on petroleum residua feedstocks at high hydroconversion levels are achieved in ebullated catalyst bed reactors only when provison is made to avoid excessive cooling of mixtures of the hydrocarbon vapor and liquid effluent materials from the reactor below a critical temperature in the downstream recovery and fractionation zones, and when the proper treatment of the vacuum residuum recycle material has been used. When these requirements are met, hydroconversion of the feed in the range of about 80–98 V %, based on disappearance of 975° F.+ material present in the fresh feed, is achieved in sustained ebullated bed reactor operations of indefinite duration.

The broad catalytic reaction conditions which can be used for this invention are 750°–900° F. temperature, 1000–5000 psig hydrogen partial pressure, and liquid space velocity of 0.1–2.5 $V_f$/hr/$V_r$. Catalyst replacement rate should usually be 0.1–2.0 pounds catalyst per barrel feed. The operating conditions of temperature, pressure and catalyst replacement rate at which these high conversions are maintained are practical and economic, in that the cost per unit of material converted is not increased significantly if at all as conversion is increased to these increased levels from those conditions operable under lower conversion conditions. Without using this invention, the problems with fouling and plugging of process equipment described above are encountered at conversion levels in the range of 65–75 V %, and operations at desired high conversion levels of 80–98 V % cannot be sustained.

This invention is useful for petroleum feedstocks containing at least about 2 W % asphaltenes, or in which the 975° F.+ fraction contains at least about 5 W % Ramsbottom carbon residues (RCR). Such feedstocks include but are not limited to crudes, atmospheric bottoms and vacuum bottoms materials obtained from petroleum fields of Alaska, Athabasca, Bachaquero, Cold Lake, Lloydminster, Orinoco and Saudia Arabia.

The hydroconversion process as described above permits the vapor products at each stage of recovery to leave the recovery zone substantially all as overhead vapor products, without condensation and refluxing within the flash-vessel recovery zone. By reducing the amount of cooling in the product recovery zone under conditions closer to adiabatic, so that a liquid temperature above a critical temperature is maintained, the degree of internal condensation of vapor is reduced. Such vapor condensation can be further minimized by stripping the liquid in the low pressure reactor liquid flash vessel, using a stripping gas, so that hydrocarbon material normally boiling below about 650° F. is stripped from the low pressure liquid.

Figure 2:
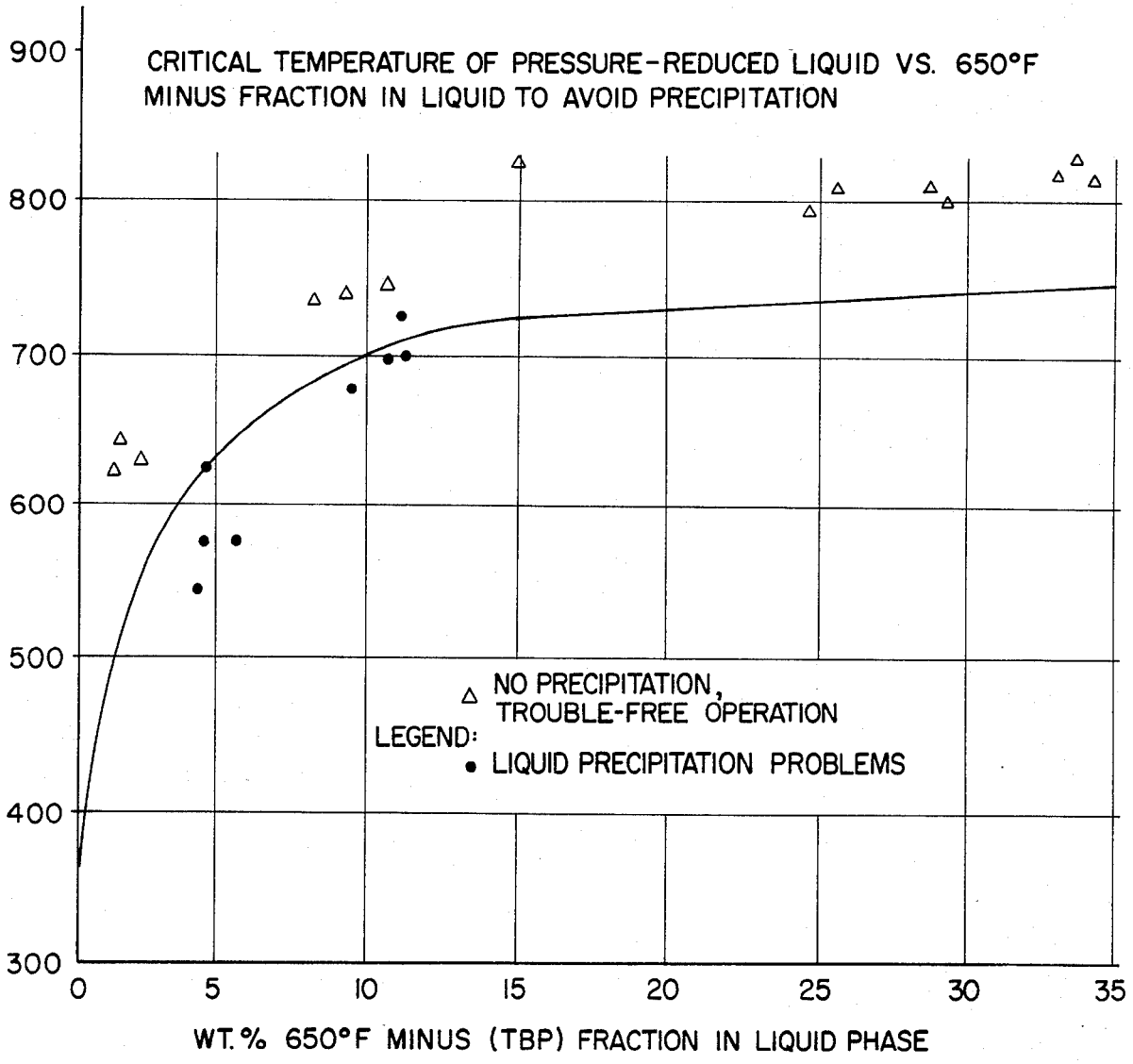
FIG. 2 is a graph showing the relationship between the critical temperature of pressure-reduced liquid and 650° F. minus fraction in the liquid.

A relationship exists between the critical pressure-reduced liquid temperature in the flash vessel and the degree of stripping used therein, such that the liquid critical temperature can be reduced when more effective stripping of the liquid is provided, either by using an increased upward flow velocity for the stripping gas or an increased number of theoretical trays, or both. It has been found that stripping of the low pressure flash vessel liquid should be sufficient that at pressure-reduced liquid temperatures below about 730° F., the liquid should contain less than about 25 W % material boiling below 650° F. Also, for each 30° F. further reduction in the liquid temperature below about 730° F., the 650° F. minus material fraction should be reduced by at least about 12 W %. Furthermore, at pressure-reduced liquid temperature below about 700° F., for each 50° F. further reduction in liquid temperature the 650° F. minus material fraction should be reduced by at least about 4 W %. For pressure-reduced liquid temperature of about 650° F., the 650° F. minus fraction of the liquid should be less than about 6 W %. Any available stripping gas which is inert to the process can be used, such as steam, hydrogen or nitrogen, with steam usually being preferred. This relationship between the critical temperature of the pressure-reduced liquid and the 650° F. minus fraction in the liquid is generally shown in FIG. 2.

In the absence of the vapor fraction, the reaction zone liquid effluent material may be cooled without the precipitation of asphaltenes and accompanying fouling or plugging problems caused by such asphaltene precipitation in the liquid. By avoiding cooling to below about 730° F., except under the conditions specified above, the vapor and liquid effluent fractions will coexist in the same zone without any asphaltene precipitation and fouling or plugging problems. Also, the cooling of the vapor fraction in the absence of the liquid creates no precipitation problems. Thus, the principle of hydrocarbon physical chemistry basic to the present invention is that, relative to the three conditions of pressure-reduced liquid fraction temperature, vapor fraction present in the liquid, and liquid fraction cooling, and two of these conditions for the pressure-reduced liquid can co-exist without causing precipitation and operating difficulty. However, the presence of all three conditions causes asphaltene precipitation and inoperability for high conversion ebullated bed operations on petroleum residua feedstocks.

Figure 1:
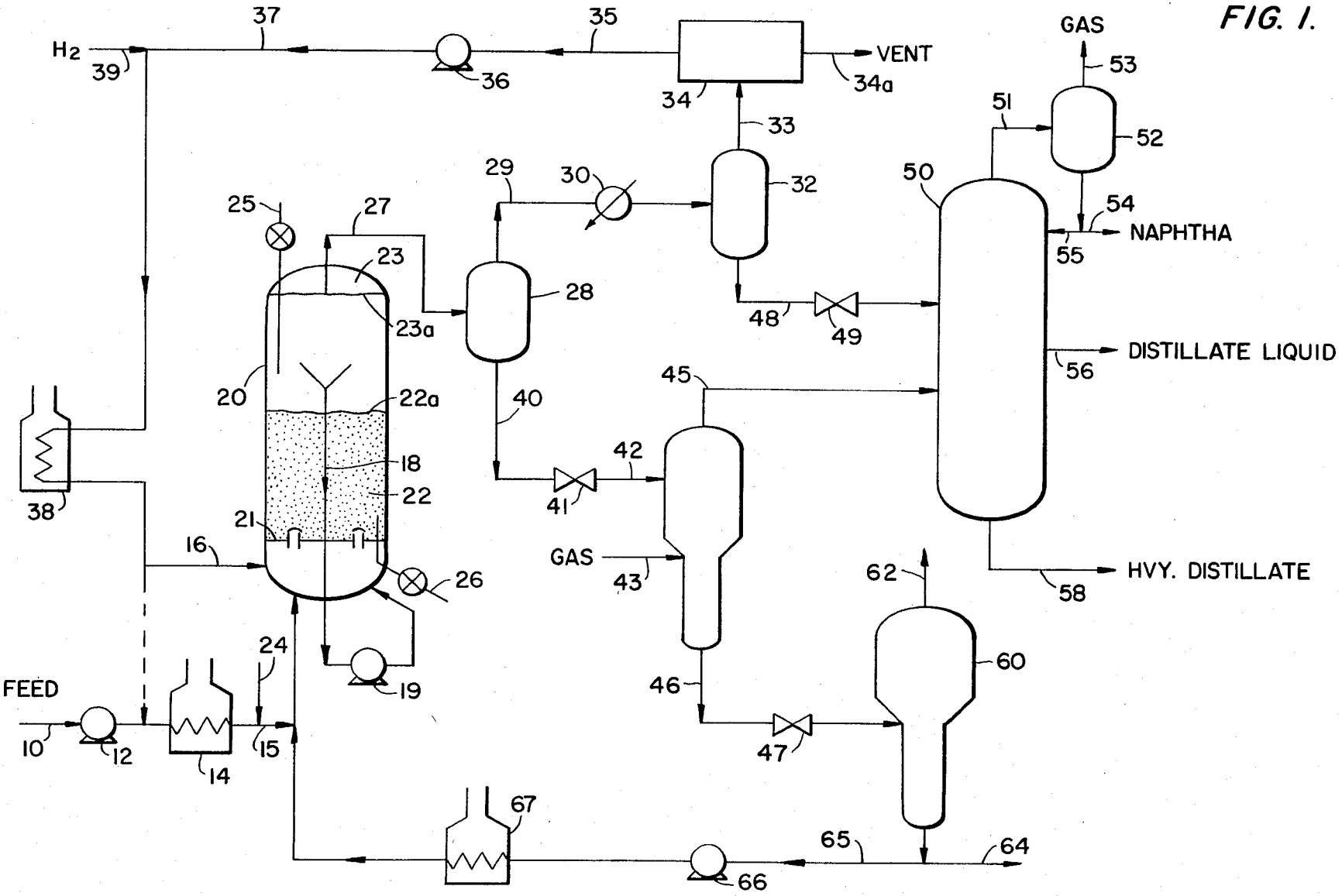
FIG. 1 is a schematic flow diagram of a hydroconversion process for petroleum residua according to the present invention.

As illustrated by FIG. 1, a heavy petroleum residua feedstock at 10, such as Arabian light or medium vacuum resid, is pressurized at 12 and passed through preheater 14 for heating to at least about 500° F. The heated feedstream at 15 is introduced into upflow ebullated bed catalytic reactor 20. Heated hydrogen is provided at 16, and is also introduced with the feedstock into reactor 20. The reactor 20 has an inlet flow distributor and catalyst support grid 21, so that the feed liquid and gas passing upwardly through the reactor 20 will expand the catalyst bed 22 by at least about 10% and usually up to about 50% over its settled height, and place the catalyst in random motion in the liquid. This reactor is typical of that described in U.S. Pat. No. Re. 25,770, wherein a liquid phase reaction occurs in the presence of a reactant gas and a particulate catalyst such that the catalyst bed is expanded.

The catalyst particles in bed 22 usually have a relatively narrow size range for uniform bed expansion under controlled liquid and gas flow conditions. While the useful catalyst size range is between about 6 and 100 mesh (U.S. Sieve Series) with an upflow liquid velocity between about 1.5 and 15 cubic feet per minute per square foot of reactor cross section area, the catalyst size is preferably particles of 6–60 mesh size including extrudates of approximately 0.010–0.130 inch diameter. We also contemplate using a once-through type operation using fine sized catalyst in the 80–270 mesh size range (0.002–0.007 inch) added with the feed, and with a liquid space velocity in the order of 0.1–2.5 cubic feed of fresh feed per hour per cubic feet of reactor volume ($V_f$/hr/$V_r$). In the reactor, the density of the catalyst particles, the liquid upward flow rate, and the lifting effect of the upflowing hydrogen gas are important factors in the expansion and operation of the catalyst bed. By control of the catalyst particle size and density and the liquid and gas velocities and taking into account the viscosity of the liquid at the operating conditions, the catalyst bed 22 is expanded to have an upper level or interface in the liquid as indicated at **22*a***. The catalyst bed expansion should be at least about 10% and seldom more than 100% of the bed settled or static level.

The hydroconversion reaction in bed 22 is greatly facilitated by use of an effective catalyst. The catalysts useful in this invention are typical hydrogenation catalysts containing activation metals selected from the group consisting of cobalt, molybdenum, nickel and tungsten and mixtures thereof, deposited on a support material selected from the group of alumina, silica, and combinations thereof. If a fine-size catalyst is used, it can be effectively introduced to the reactor at connection 24 by being added to the feed in the desired concentration, as in a slurry. Catalyst may also be periodically added directly into the reactor 20 through suitable inlet connection means 25 at a rate between about 0.1 and 2.0 lbs catalyst/barrel feed, and used catalyst is withdrawn through suitable withdrawal means 26.

Recycle of reactor liquid from above the solids interface 22a to below the flow distributor grid 21 is usually needed to establish a sufficient upflow liquid velocity to maintain the catalyst in random motion in the liquid and to facilitate an effective reaction. Such liquid recycle is preferably accomplished by the use of a central downcomer conduit 18 which extends to a recycle pump 19 located below the flow distributor 21, to assure a positive and controlled upward movement of the liquid through the catalyst bed 22. The recycle of liquid through internal conduit 18 has some mechanical advantages and tends to reduce the external high pressure piping connections needed in a hydroconversion reactor, however, liquid recycle upwardly through the reactor can be established by a recycle conduit and pump located external to the reactor.

Operability of the ebullated catalyst bed reactor system to assure good contact and uniform (iso-thermal) temperature therein depends not only on the random motion of the relatively small catalyst in the liquid environment resulting from the buoyant effect of the upflowing liquid and gas, but also requires the proper reaction conditions. With improper reaction conditions insufficient hydroconversion is achieved, which results in a non-uniform distribution of liquid flow and operational upsets, usually resulting in excessive coke deposits on the catalyst. Different feedstocks are found to have more or less asphaltene precursors which tend to aggravate the operability of the reactor system including the recycle pump and piping due to the plating out of tarry deposits. While these deposits can usually be washed off by ligher diluent materials, the catalyst in the reactor bed may become completely coked up and require premature shut down of the process unless undesired precipitation of such asphaltenes materials is avoided.

For the heavy petroleum residua feedstocks of this invention, i.e. those having asphaltenes at least about 2 W %, the operating conditions used in the reactor 20 are within the broad ranges of 750°–900° F. temperature, 1000–5000 psig, hydrogen partial pressure, and space velocity of 0.1–2.5 $V_f$/hr/$V_r$ (volume feed per hour per volume of reactor). Preferred conditions are 780°–850° F. temperature, 1200–2800 psig, hydrogen partial pressure, and space velocity of 0.20–1.5 $V_f$/hr/$V_r$. Usually more preferred conditions are 800°–840° F. temperature and 1250–2500 psig hydrogen partial pressure. The feedstock hydroconversion achieved is at least about 75 V % for once-through single stage type operations.

In the catalytic reactor 20, a vapor space 23 exists above the liquid level 23a and an overhead stream containing both liquid and gas fractions is withdrawn at 27, and passed to hot phase separator 28. The resulting gaseous portion 29 is principally hydrogen, which is cooled at heat exchanger 30, and passed to gas/liquid phase separator 32. The resulting gaseous fraction 33 is passed to gas purification step 34. The recovered hydrogen stream at 35 can be warmed at heat exchanger 30 and is recycled by compressor 36 through conduit 37, reheated at heater 38, and is passed as stream 16 into the bottom of reactor 20, along with make-up hydrogen at 39 as needed.

From hot phase separator 28, liquid portion stream 40 is withdrawn, pressure-reduced at 41 to pressure below about 200 psig, preferably to below about 100 psig pressure, and passed to flash vessel 44. The resulting vapor 45 is usually passed to fractionation step 50. A stripping gas such as nitrogen or steam is provided at 43 to usually strip substantially all fractions boiling below about 650° F. out of the remaining liquid in the flash vessel 44. The resulting stripped liquid at 46 can be passed either to atmospheric pressure distillation at fractionator 50 or to vacuum distillation step at 60, or a portion to each.

A condensed vapor stream also from phase separator step 32, is withdrawn at 48 pressure-reduced at 49, and also passed to fractionation step 50, from which is withdrawn a low pressure vapor stream 51. This vapor stream is phase separated at 52 to provide low pressure gas 53 and liquid stream 55 to provide reflux liquid to fractionator 50, and a naphtha product stream 54. A middle boiling range distillate liquid product stream is withdrawn at 56, and a heavy hydrocarbon product liquid stream is withdrawn at 58.

From vacuum distillation step 60, a vacuum gas oil stream is withdrawn overhead at 62, and vacuum bottoms stream is withdrawn at 64. Preferably, a portion 65 of the vacuum bottoms material usually boiling above about 875° F. is pressurized by pump 66, reheated at heater 67 and recycled to reactor 20 for further hydroconversion, such as to achieve 80–98 V % conversion to lower boiling materials. The volume ratio of the recycled 875° F.+ material compared to the fresh feed should be within a range of about 0.2–1.5. The heavy vacuum pitch material is withdrawn at 64 for further processing as desired.

FIG. 1 shows a typical cross-sectional view of the liquid fraction flash vessel 44, in which the vapor stripping step occurs. The pressure-reduced liquid stream enters at 42. The stripping gas such as steam is provided at 43 and passed upwardly through the vessel, to strip out the fractions normally boiling below about 650° F., and effluent vapor is withdrawn at 45. The resulting stripped hydrocarbon liquid from which those fractions boiling below about 650° F. have been removed is withdrawn at 46. The velocity of the stripping gas within flash vessel 44 should be at least about 0.03 ft/sec and preferably about 0.04–0.08 ft/sec.

This invention is also useful for a two-stage catalytic conversion process for petroleum residua feedstocks, using two catalytic reactors connected in series flow arrangement. The effluent stream from the second stage reactor is phase separated and the resulting liquid fraction is flashed at low pressure and then treated in accordance with this invention. If recycle is vacuum bottoms material is used for achieving increased hydroconversion, it is recycled to the first stage reactor.

This invention will be more fully described and better understood by reference to the following examples of actual hydroconversion operations, which should not be construed as limiting the scope of the invention.

EXAMPLE

High hydroconversion operations were conducted on a vacuum resid material consisting of a 70/30 mixture of Arabian light/medium vacuum resids. The feedstock characteristics are given in Table 1.

TABLE 1

CHARACTERISTICS OF 70/30 ARABIAN LIGHT/MEDIUM VACUUM RESID

| Run No. | 130–98 | 130–98 & 99 |
|---|---|---|
| Quantity, Gallons | 12,000 | 20,000 |
| Gravity, °API | | |
| Elemental Analyses | | |
| Sulfur, W % | 4.73 | 4.51 |
| Nitrogen, W % | 0.30 | 0.25 |
| Carbon, W % | 84.88 | 84.26 |
| Hydrogen, W % | 10.48 | 10.24 |
| Oxygen, W % | <0.5 | — |
| Vanadium, Wppm | 85 | 96 |
| Nickel, Wppm | 24 | 23 |
| Iron, Wppm | 17 | 16 |
| Sodium, Wppm | 6 | 7 |
| Calcium, Wppm | 4 | 1 |
| Chlorides, Wppm | 9 | 18 |
| Ash, W % | 0.01 | 0.05 |
| Pentane Insolubles, W % | 15.58 | 13.66 |
| Heptane Sediment and Water, V % | 1.0 | <0.25 |
| Ramsbottom Carbon Residue, W % | 19.69 | 19.74 |
| Viscosity, SFS at 210° F. | 532 | 486 |
| Initial Boiling Point, °F. | 824 | 765 |
| IBP-1000° F. Fraction | | |
| Volume % | 5.5 | 7.0 |
| Gravity, °API | 18.1 | 16.2 |
| Sulfur, W % | 3.56 | 3.34 |
| Ramsbottom Carbon Residue, W % | 1.65 | 1.18 |
| 1000° F.+ Fraction | | |
| Volume % | 94.5 | 93 |
| Gravity, °API | 7.2 | 6.6 |
| Sulfur, W % | 4.72 | 4.60 |
| Ramsbottom Carbon Residue, W % | 20.96 | 20.62 |
| Ash, W % | 0.04 | 0.02 |
| Pentane Insolubles, W % | 16.23 | 15.28 |
| Viscosity, SFS at 210° F. | — | 758 |

The reaction conditions used and conversion levels achieved in this operation are shown in Table 2.

TABLE 2

HIGH HYDROCONVERSION OPERATIONS ON ARABIAN VACUUM RESIDUA FEEDSTOCK

| No. of Reactor Stages | 1 | 1 | 1 |
|---|---|---|---|
| Conversion, LV % | 75 | 80 | 86 |
| Reactor Temperature, °F. | 803 | 813 | 819 |
| Hydrogen Pressure, Psig | 2300 | 2290 | 2270 |
| LHSV, V/Hr/Vr | 0.28 | 0.28 | 0.28 |
| Catalyst Space Velocity, B/D/Lb | 0.07 | 0.07 | 0.07 |
| Chemical Hydrogen Consumption, SCF/Bbl | 1172 | 1297 | 1433 |
| Catalyst Replacement Rate, Lb/BbL | 0.35 | 0.35 | 0.35 |
| Yields | | | |
| $H_2S$, $NH_3$, $H_2O$, W % | 4.1 | 4.0 | 4.1 |
| $C_1$–$C_3$, W % | 4.2 | 5.1 | 5.9 |
| $C_4$–180° F., V% 4.9 | 6.1 | 6.6 | |
| 180–360° F., V % | 10.8 | 11.7 | 15.1 |
| 360–650° F., V % | 30.8 | 34.4 | 38.2 |
| 650–1000° F., V % | 34.2 | 33.9 | 31.8 |
| 1000° F.+, V % | 23.5 | 18.4 | 13.2 |
| $C_4$+ | 104.6 | 104.5 | 104.1 |
| $C_4$+, °API | 24.4 | 25.9 | 27.7 |

The conditions used in the liquid flash vessel and results obtained using normal operations and the conditions in accordance with this invention are provided in Table 3.

TABLE 3

PERFORMANCE FACTORS IN OPERATION OF REACTOR LIQUID FLASH VESSEL

| | Prior Conditions | Conditions For The Invention |
|---|---|---|
| Stripping Gas Used | None | Nitrogen |
| Vapor Velocity, Ft/Sec | 0.03 | 0.05 |
| Liquid Velocity, Ft/Sec | 0.85 | 0.43 |
| Liquid Residence Time, Min | 47 | 11 |
| Inlet Temperature, °F. | 550–600 | 730 |
| Vapor Temperature, °F. | 500 | 690 |
| Liquid Temperature, °F. | 585 | 630 |
| Bottoms Product Distillation | | |
| IBP–650° F. | 5 | 2 |
| 650–1000° F. | 52 | 38 |
| +1000° F. | 38 | 62 |
| Bottoms Product HS & W, W % | 16 | 14–12 |

Figure 3:
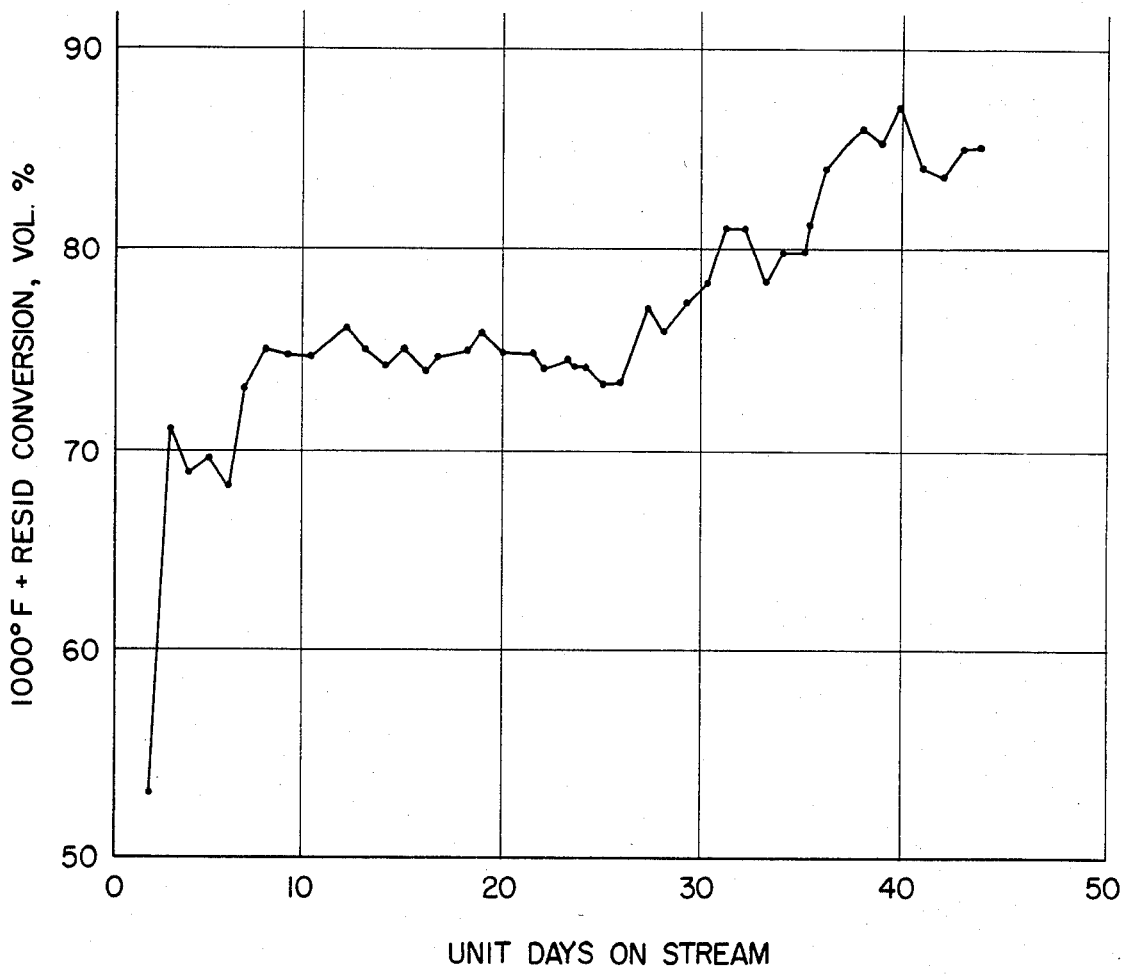
FIG. 3 is a graph showing sustained hydroconversion results for petroleum residua feedstocks.

By using the low pressure liquid flashing conditions of the invention, smooth downstream operations without precipitation of asphaltene compounds were achieved. The results of resid percent conversion is shown in FIG. 3. Also, as a result of using the invention, satisfactory operation of a 25 bbl/day Process Development Unit was successfully sustained over a continuous 44-day period. In all high conversion operation attempts prior to the use of this invention, operations at conversion levels in the range of only about 70 V % could not be sustained more than a few days.

Although this invention has been described broadly and in terms of certain preferred embodiments, it will be understood that modifications and variations to the process can be made within the spirit and scope of the invention, which is defined by the following claims.

We claim:

1. A process for high conversion of petroleum residua containing at least about 25 V % material boiling above about 975° F. to produce lower boiling hydrocarbon liquid products, comprising the steps of:

(a) feeding a petroleum residua feedstock together with hydrogen into a reaction zone containing an ebullated catalyst bed, maintaining said reaction zone at 750°–900° F. temperature, 1000–5000 psig hydrogen partial pressure for liquid phase reaction to produce a hydroconverted material containing a mixture of gas and liquid fractions;

(b) separating said gas fraction from said liquid fractions while maintaining the liquid fraction temperature above about 730° F. to avoid precipitation of asphaltene compounds in the liquid;

(c) pressure-reducing said liquid fraction to a pressure below about 200 psig and flashing vapor from the liquid fraction while maintaining the resulting liquid temperature above a critical temperature of about 730° F. to avoid precipitation of asphaltenes; and (d) distilling said liquid fractions from step (c) at a vacuum pressure to produce hydrocarbon liquid products having a boiling temperature below about 875° F.

2. The process of claim 1, wherein a vacuum bottoms material is withdrawn from said distillation step.

3. The process of claim 1, wherein a combination of pressure-reduced liquid fraction temperature and stripping is used so that for pressure-reduced liquid temperature below about 730° F. the liquid contains less than about 25 W % material normally boiling below 650° F. and for each 30° F. further reduction in said liquid temperature the 650° F. minus material fraction contained therein is reduced by at least about 12 W %.

4. The process of claim 1, wherein a combination of pressure-reduced liquid fraction temperature and liquid stripping is used so that for pressure-reduced liquid temperatures below about 700° F. the liquid contains less than about 12 W % material normally boiling below 650° F. and for each 50° F. further reduction in said liquid temperature the 650° F. minus material fraction contained therein is reduced by at least about 6 W %.

5. The process of claim 1, wherein a combination of pressure-reduced liquid temperature and stripping in used to maintain in said pressure-reduced hydrocarbon material liquid the fraction normally boiling below about 650° F. to less than about 6 V %.

6. The process of claim 1, wherein substantially all hydrocarbon material normally boiling below about 650° F. is vapor stripped from said low pressure flashed hydrocarbon liquid.

7. The process of claim 5, wherein said hydrocarbon material is stripped with steam.

8. The process of claim 5, wherein said hydrocarbon material is stripped with nitrogen.

9. The process of claim 6, wherein the hydrocarbon liquid remaining after said vapor stripping is cooled to about 650° F.

10. The process of claim 5, wherein the liquid residence time of said low pressure liquid during stripping and prior to said distillation is less than about 30 minutes.

11. The process of claim 2, wherein a portion of said vacuum bottoms material boiling above about 875° F. is recycled to said reaction zone to increase the percent hydroconversion.

12. The process of claim 1, wherein the reaction zone temperature is 780°–850° F., hydrogen partial pressure is 1200–2800 psig, and space velocity is 0.2–1.5 $V_f/hr/V_r$.

13. The process of claim 1, wherein said hydroconverted material from said catalytic reaction zone is passed to a second stage catalytic reaction zone for achieving increased hydroconversion prior to the separation step.

14. The process of claim 13, wherein a vacuum bottoms material is produced and a portion of said vacuum bottoms material is recycled to the first stage catalytic reaction zone for achieving increased percentage hydroconversion.

15. A process for high conversion of petroleum residua containing at least about 25 V % material boiling above about 975° F. to produce lower boiling hydrocarbon liquid products, comprising the steps of:

(a) feeding a petroleum residuum feedstock together with hydrogen into a reaction zone containing an ebullated catalyst bed, maintaining said reaction zone at 750°–900° F. temperature, 1000–5000 psig hydrogen partial pressure and 0.1–2.5 Vf/hr/Vr space velocity for liquid phase reaction to produce a hydroconverted material containing a mixture of gas and liquid fractions;

(b) separating said gas fractions from said liquid fractions while maintaining the liquid fractions temperature above about 730° F. to avoid precipitation of asphaltene compounds in the liquid;

(c) pressure-reducing said liquid fractions to a pressure below about 100 psig and flashing vapor from the liquid fractions and stripping the material normally boiling below about 650° F. while maintaining the resulting liquid temperature above a critical temperature above about 650° F. to avoid precipitation of asphaltenes; and (d) distilling said liquid fractions from step (c) at a vacuum pressure to produce hydrocarbon liquid products having a boiling temperature below about 875° F. and a vacuum bottoms material, a portion of which is recycled to said reaction zone.

16. A process for high conversion of petroleum residua containing at least about 25 V % material boiling above about 975° F. to produce lower boiling hydrocarbon liquid products, comprising the steps of:

(a) feeding a petroleum residua feedstock together with hydrogen into a reaction zone containing an ebullated catalyst bed, maintaining said reaction zone at 750°–900° F. temperature, and 1000–5000 psig hydrogen partial pressure for liquid phase reaction to produce a hydroconverted material containing a mixture of gas and liquid fractions;

(b) separating said gas fraction from said liquid fractions while maintaining the liquid fraction temperature above about 730° F. to avoid precipitation of asphaltene compounds in the liquid;

(c) pressure-reducing said liquid fraction to a pressure below about 200 psig and flashing vapor from the liquid fraction while maintaining the resulting liquid temperature above a critical temperature of about 650° F. to avoid precipitation of asphaltenes;

(d) stripping said pressure-reduced liquid fraction with a stripping gas to remove hydrocarbon fractions boiling below about 650° F.; and (e) distilling said liquid fractions from step (d) at a vacuum pressure to produce hydrocarbon liquid products having a boiling temperature below about 875° F.

17. The process of claim 16, wherein the stripping gas is steam.

* * * * *